US009151549B2

(12) United States Patent
Goodson et al.

(10) Patent No.: US 9,151,549 B2
(45) Date of Patent: Oct. 6, 2015

(54) METHOD AND APPARATUS FOR ELECTRICAL CONTROL OF HEAT TRANSFER

(75) Inventors: David Goodson, Sequim, WA (US); Thomas S. Hartwick, Snohomish, WA (US); Christopher A. Wiklof, Everett, WA (US)

(73) Assignee: ClearSign Combustion Corporation, Seattle, WA (US)

( * ) Notice: Subject to any disclaimer, the term of this patent is extended or adjusted under 35 U.S.C. 154(b) by 1219 days.

(21) Appl. No.: 13/006,344

(22) Filed: Jan. 13, 2011

(65) Prior Publication Data

US 2011/0203771 A1 Aug. 25, 2011

Related U.S. Application Data

(60) Provisional application No. 61/294,761, filed on Jan. 13, 2010.

(51) Int. Cl.

| | |
|---|---|
| ***F28F 13/00*** | (2006.01) |
| ***F28F 13/16*** | (2006.01) |
| ***F15D 1/02*** | (2006.01) |
| ***F23C 99/00*** | (2006.01) |

(52) U.S. Cl.
CPC . *F28F 13/16* (2013.01); *F15D 1/02* (2013.01); *F23C 99/001* (2013.01); *Y10T 137/0324* (2015.04); *Y10T 137/2082* (2015.04)

(58) Field of Classification Search
CPC ..... F15D 1/02
USPC ..... 165/96; 137/2, 807
See application file for complete search history.

(56) References Cited

U.S. PATENT DOCUMENTS

| | | | |
|---|---|---|---|
| 1,153,182 | A | 9/1915 | Schniewind |
| 2,604,936 | A | 7/1952 | Kaehni et al. |
| 3,087,472 | A | 4/1963 | Asakawa |
| 3,224,485 | A | 12/1965 | Blomgren et al. |
| 3,306,338 | A | 2/1967 | Wright et al. |
| 3,358,731 | A | 12/1967 | Donnelly |
| 3,416,870 | A | 12/1968 | Wright |
| 3,503,348 | A | 3/1970 | Dvirka |
| 3,749,545 | A | 7/1973 | Velkoff |
| 3,841,824 | A | 10/1974 | Bethel |
| 3,869,362 | A | 3/1975 | Machi et al. |
| 4,052,139 | A | 10/1977 | Paillaud et al. |
| 4,091,779 | A | 5/1978 | Saufferer et al. |

(Continued)

FOREIGN PATENT DOCUMENTS

| | | |
|---|---|---|
| JP | 2007-317656 | 6/2007 |
| WO | WO 96/01394 | 1/1996 |

OTHER PUBLICATIONS

James Lawton and Felix J. Weinberg. "Electrical Aspects of Combustion". Clarendon Press, Oxford. 1969.

(Continued)

*Primary Examiner* — Alissa Tompkins
*Assistant Examiner* — John Bargero
(74) *Attorney, Agent, or Firm* — Christopher A. Wiklof; Nicholas S. Bromer; Launchpad IP, Inc.

(57) ABSTRACT

A heat exchange system includes an electrode configured to electrostatically control a flow of a heated gas stream in the vicinity of a heat transfer surface and/or a heat-sensitive surface.

35 Claims, 8 Drawing Sheets

(56) References Cited

U.S. PATENT DOCUMENTS

| | | | | |
|---|---|---|---|---|
| 4,093,430 | A | 6/1978 | Schwab et al. | |
| 4,110,086 | A | 8/1978 | Schwab et al. | |
| 4,111,636 | A | 9/1978 | Goldberg | |
| 4,118,202 | A | 10/1978 | Scholes | |
| 4,219,001 | A | 8/1980 | Kumagai et al. | |
| 4,260,394 | A | 4/1981 | Rich | |
| 4,304,096 | A | 12/1981 | Liu et al. | |
| 4,340,024 | A | 7/1982 | Suzuki et al. | |
| 4,439,980 | A | 4/1984 | Biblarz et al. | |
| 4,649,260 | A | 3/1987 | Melis et al. | |
| 4,675,029 | A | 6/1987 | Norman et al. | |
| 4,903,616 | A | 2/1990 | Mavroudis | |
| 4,987,839 | A | 1/1991 | Krigmont et al. | |
| 5,702,244 | A | 12/1997 | Goodson et al. | |
| 6,374,909 | B1 * | 4/2002 | Jeter et al. | 165/96 |
| 6,640,549 | B1 | 11/2003 | Wilson et al. | |
| 6,736,133 | B2 | 5/2004 | Bachinski et al. | |
| 6,742,340 | B2 | 6/2004 | Nearhoof, Sr. et al. | |
| 6,918,755 | B1 | 7/2005 | Johnson et al. | |
| 7,137,808 | B2 | 11/2006 | Branston et al. | |
| 7,168,427 | B2 | 1/2007 | Bachinski et al. | |
| 7,182,805 | B2 | 2/2007 | Reaves | |
| 7,226,496 | B2 | 6/2007 | Ehlers | |
| 7,226,497 | B2 | 6/2007 | Ashworth | |
| 7,243,496 | B2 | 7/2007 | Pavlik et al. | |
| 7,377,114 | B1 | 5/2008 | Pearce | |
| 7,523,603 | B2 | 4/2009 | Hagen et al. | |
| 7,845,937 | B2 | 12/2010 | Hammer et al. | |
| 8,082,725 | B2 | 12/2011 | Younsi et al. | |
| 8,245,951 | B2 | 8/2012 | Fink et al. | |
| 2003/0203245 | A1 * | 10/2003 | Dessiatoun et al. | 429/8 |
| 2005/0208442 | A1 | 9/2005 | Heiligers et al. | |
| 2007/0020567 | A1 | 1/2007 | Branston et al. | |
| 2010/0183424 | A1 | 7/2010 | Roy | |
| 2011/0203771 | A1 | 8/2011 | Goodson et al. | |
| 2012/0317985 | A1 | 12/2012 | Hartwick et al. | |
| 2013/0004902 | A1 | 1/2013 | Goodson et al. | |
| 2013/0071794 | A1 | 3/2013 | Colannino et al. | |
| 2013/0170090 | A1 | 7/2013 | Colannino et al. | |
| 2013/0230810 | A1 | 9/2013 | Goodson et al. | |
| 2013/0230811 | A1 | 9/2013 | Goodson et al. | |
| 2013/0255482 | A1 | 10/2013 | Goodson | |
| 2013/0255548 | A1 | 10/2013 | Goodson et al. | |
| 2013/0255549 | A1 | 10/2013 | Sonnichsen et al. | |
| 2013/0260321 | A1 | 10/2013 | Colannino et al. | |

OTHER PUBLICATIONS

Altendrfner et al., "Electric Field Effects on Emissions and Flame Stability With Optimized Electric Field Geometry", Third European Combustion Meeting ECM 2007, p. 1-6.

William T. Brande; "The Bakerian Lecture: On Some New Electro-Chemical Phenomena", Phil. Trans. R. Soc. Lond. 1814 104, p. 51-61.

* cited by examiner

METHOD AND APPARATUS FOR ELECTRICAL CONTROL OF HEAT TRANSFER

CROSS-REFERENCE TO RELATED APPLICATIONS

The present application claims priority benefit under 35 USC §119(e) to U.S. Provisional Application Ser. No. 61/294,761; entitled "METHOD AND APPARATUS FOR ELECTRICALLY ACTIVATED HEAT TRANSFER", invented by David Goodson, Thomas S. Hartwick, and Christopher A. Wiklof, filed on Jan. 13, 2010, which is currently herewith, and which, to the extent not inconsistent with the disclosure herein, incorporated by reference.

BACKGROUND

Typical external combustion systems such as combustors and boilers may include relatively complicated systems to maximize the extraction of heat from a heated gas stream. Generally, such systems may rely on forced or natural convection to transfer heat from the heated gas stream through heat transfer surfaces to heat sinks.

Other systems, which may include the combustion systems indicated above, or may include other systems such as turbojet engines, ram- or scram-jet engines, and rocket engines, for example, are limited with respect to combustion temperature or reliability due to erosion of critical parts by hot gases. It would be desirable to reduce heat transfer to temperature-sensitive surfaces of such systems.

SUMMARY

According to an embodiment, a system for electrically stimulated heat transfer may include at least one first electrode positioned adjacent to a heated gas stream, and at least one heat transfer surface positioned near the at least one electrode. The heated gas stream may include positively and/or negatively charged species evolved from a combustion reaction. At least one first electrode may be electrically modulated to attract the positively and/or negatively charged species toward the at least one heat transfer surface. The attracted charged species may entrain heat-bearing non-charged species. The flow of heat-bearing charged and non-charged species may responsively flow near the at least one heat transfer surface and transfer heat energy from the heated gas stream to a heat sink corresponding to the at least one heat transfer surface.

According to another embodiment, at least one second electrode may selectively remove one or more charged species from the heated gas stream. The heated gas stream may thus exhibit a charge imbalance that may be maintained as the heated gas stream flows in the vicinity of the at least one first electrode.

According to another embodiment a heat transfer surface may include an integrated electrode configured for electrostatic attraction of charged species in a heated gas stream. The attracted charged species may entrain heated non-charged species. The integrated electrode may be electrically isolated from the heat transfer surface.

According to another embodiment, a method for stimulating heat transfer may include providing a heated gas carrying electrically charged species, modulating a first electrode to drive the heated gas to flow adjacent to a heat transfer surface, and transferring heat from the gas to the heat transfer surface.

According to another embodiment, a method for protecting a temperature-sensitive surface may include providing a heated gas carrying electrically charged species and modulating a first electrode to drive the heated gas to flow distal from a temperature-sensitive surface to reduce the transfer of heat from the gas to the temperature-sensitive surface.

According to another embodiment, an apparatus for reducing heat transfer from a combustion reaction may include a temperature-sensitive surface positioned in a hot gas stream including electrically charged species from a combustion reaction and a first electrode configured to be modulated to drive the electrically charged species from the combustion reaction to a location away from the temperature-sensitive surface.

DETAILED DESCRIPTION

Figure 1:
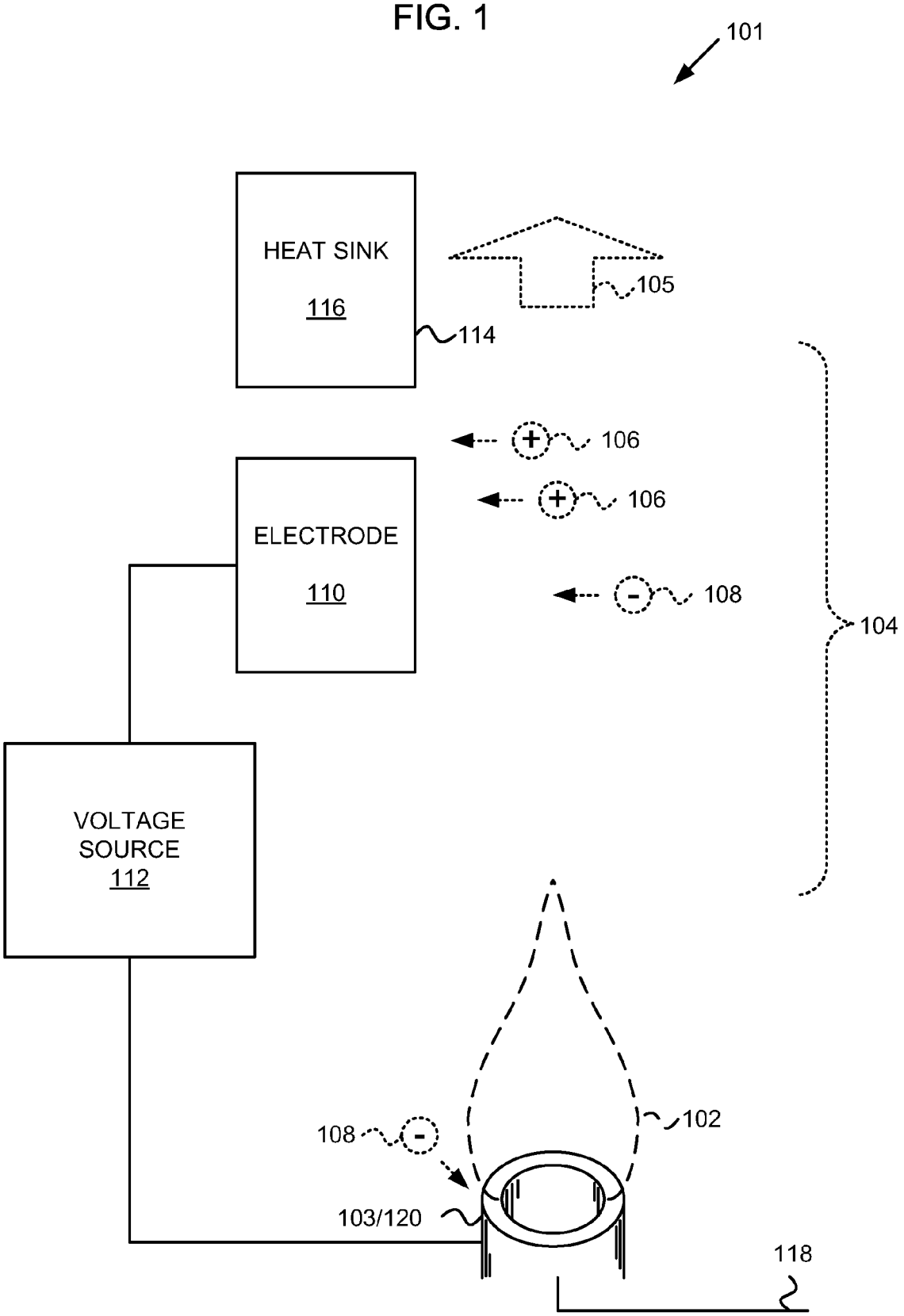
FIG. 1 is a diagram of a system configured to stimulate heat transfer to a heat transfer surface using an electric field, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

FIG. 1 is a diagram of a system 101 configured to stimulate heat transfer to a heat transfer surface 114 using an electric field, according to an embodiment. The system 101 may typically include a flame 102 supported by a burner assembly 103. A combustion reaction in the flame 102 generates a heated gas 104 (having a flow illustrated by the arrow 105) carrying electrically charged species 106, 108. Typically, the electrically charged species include positively charged species 106 and negatively charged species 108.

Providing a heated gas carrying charged species 106, 108 may include burning at least one fuel from a fuel source 118, the combustion reaction providing at least a portion of the charged species and combustion gasses. According to some embodiments, the combustion reaction may provide substantially all the charged species 106, 108.

The charged species 106, 108 may include unburned fuel; intermediate radicals such as hydride, hydroperoxide, and hydroxyl radicals; particulates and other ash; pyrolysis products; charged gas molecules; and free electrons, for example. At various stages of combustion, the mix of charged species 106, 108 may vary. As will be discussed below, some embodiments may remove a portion of the charged species 106 or 108 in a first portion of the heated gas 104, leaving a charge imbalance in another portion of the heated gas 104.

For example, one embodiment may remove a portion of negative species 108 including substantially only electrons, leaving a positive charge imbalance in the gas stream 104. Positive species 106 and remaining negative species 108 may then be electrostatically attracted to the vicinity of a heat sink 116, resulting in a stimulation of heat transfer. Alternatively, a portion of positive species 106 may be removed from the heated gas stream 104, leaving a negative charge imbalance in the gas stream.

A first electrode 110 may be voltage modulated by a voltage source 112. The voltage modulation may be configured to attract a portion of the charged species 106, here illustrated as positive. Modulating the first electrode may include driving the first electrode to one or more voltages selected to attract oppositely charged species, and the attracted oppositely charged species imparting momentum transfer to the heated gas.

The momentum transfer from the electrically driven charged species 106 may be regarded as entraining non-charged particles, unburned fuel, ash, etc. carrying heat. The modulated first electrode 110 may be configured to attract the charged species and other entrained species carrying heat to preferentially flow adjacent to a heat transfer surface 114. As the heat-carrying species flow adjacent to the heat transfer surface 114, a portion of the heat carried by the species is transferred through the heat transfer surface 114 to a heat sink 116.

According to an embodiment, the first electrode 110 may be arranged near the heat transfer surface 114. A nominal mass flow 105 may be characterized by a velocity (including speed and direction). The first electrode 110 may be configured to impart a drift velocity to the charged species 106 at an angle to the nominal mass flow velocity 105 and toward the heat transfer surface 114.

As mentioned above, the system 101 may further modulate at least one second electrode 120 to remove a portion of the charged species 106, 108. According to an embodiment, the second electrode 120 may preferentially purge negatively-charged species 108 from the heated gas 104. According to an embodiment, the second electrode may preferentially purge a portion of electrons 108 from the heated gas 104.

According to an embodiment, the at least one second electrode 120 includes a burner assembly 103 that supports a flame 102, the flame 102 providing a locus for the combustion reaction. The second electrode 120 may be driven with a waveform from the voltage source 112. Alternatively, the second electrode may be driven from another voltage source.

While the flame 102 is illustrated in a shape typical of a diffusion flame, other combustion reaction distributions may be provided, depending upon a given embodiment.

Figure 2:
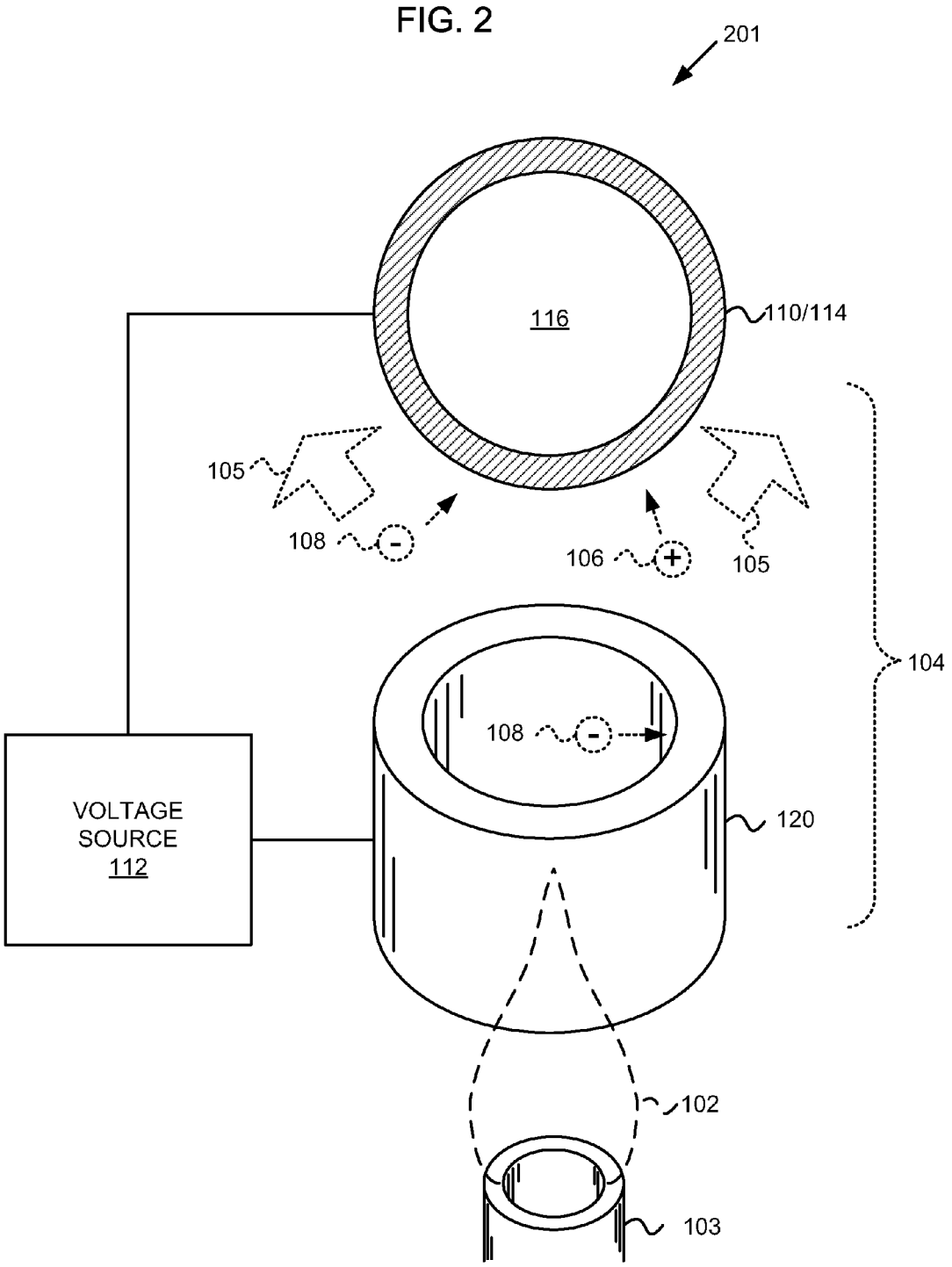
FIG. 2 is a diagram of a system having alternative electrode arrangement compared to the system of FIG. 1, according to an embodiment.

FIG. 2 is a diagram of a system 201 having alternative electrode arrangement compared to the system 101 of FIG. 1, according to an embodiment. The system 201 may include a first electrode 110 that is integrated with the heat transfer surface 114. The system 201 may additionally or alternatively include an optional second electrode 120 that is separate from the burner assembly 103. As with the system 101 of FIG. 1, the burner assembly 103 is configured to support a flame 102 that provides a locus for combustion and generation of at least a portion of the charged particles 106, 108 carried in the heated gas 104.

A heat sink 116 may be positioned in the heated gas stream 104 as illustrated. As the heated gas stream flows past the heat sink 116, the flow may split, as illustrated by the arrows 105. According to an embodiment, at least one electrode 110, here illustrated as being integrated with the heat transfer surface 114 adjoining the heat sink 116, may be modulated to electrostatically attract charged species 106 and/or 108. As may be appreciated, such attraction may tend to move the charged species 106, 108 along paths at angles to the mean gas flow velocity 105.

One possible outcome of carrying positive 106 and negative 108 species through the entirety of the heated gas stream 104 is recombination, whereby a positive charge 106 combines with a negative charge 108 to produce one or more neutral species (not shown). Such recombination may reduce the coupling efficiency between the first electrode 110 and the heated gas 104 by reducing the concentration of charged species 106 responsive to a voltage on the first electrode 110.

As with the description corresponding to FIG. 1, the placement of a positive species attractive electrode (e.g. the first electrode 110) and negative species attractive electrode (e.g. the second electrode 120) represents an embodiment. Other embodiments may reverse the relationship and/or otherwise modify the embodiment of FIG. 2 without departing from the spirit or scope of this description.

According to the embodiment 201, the at least one second electrode 120 includes an electrode positioned at a location nearer the burner assembly 103 than the distance between the burner assembly 103 and the heat transfer surface 114. For example, the at least one second electrode 120 may be positioned and driven to sweep electrons 108 out of the flow of the heated gas 104. The modulation of the at least one second electrode 120 may include providing an alternating voltage. The voltage to which the voltage driver 112 drives the second electrode 120 may attract the electrons 108 to the surface of the second electrode 120. The electrons 108 may combine with a positively charged conductor including the at least one second electrode 120 and thus be removed from the heated gas stream 104.

While the open cylindrical or toric shape of the second electrode 120 represents one embodiment, alternative shapes may be appropriate for alternative embodiments.

Figure 3:
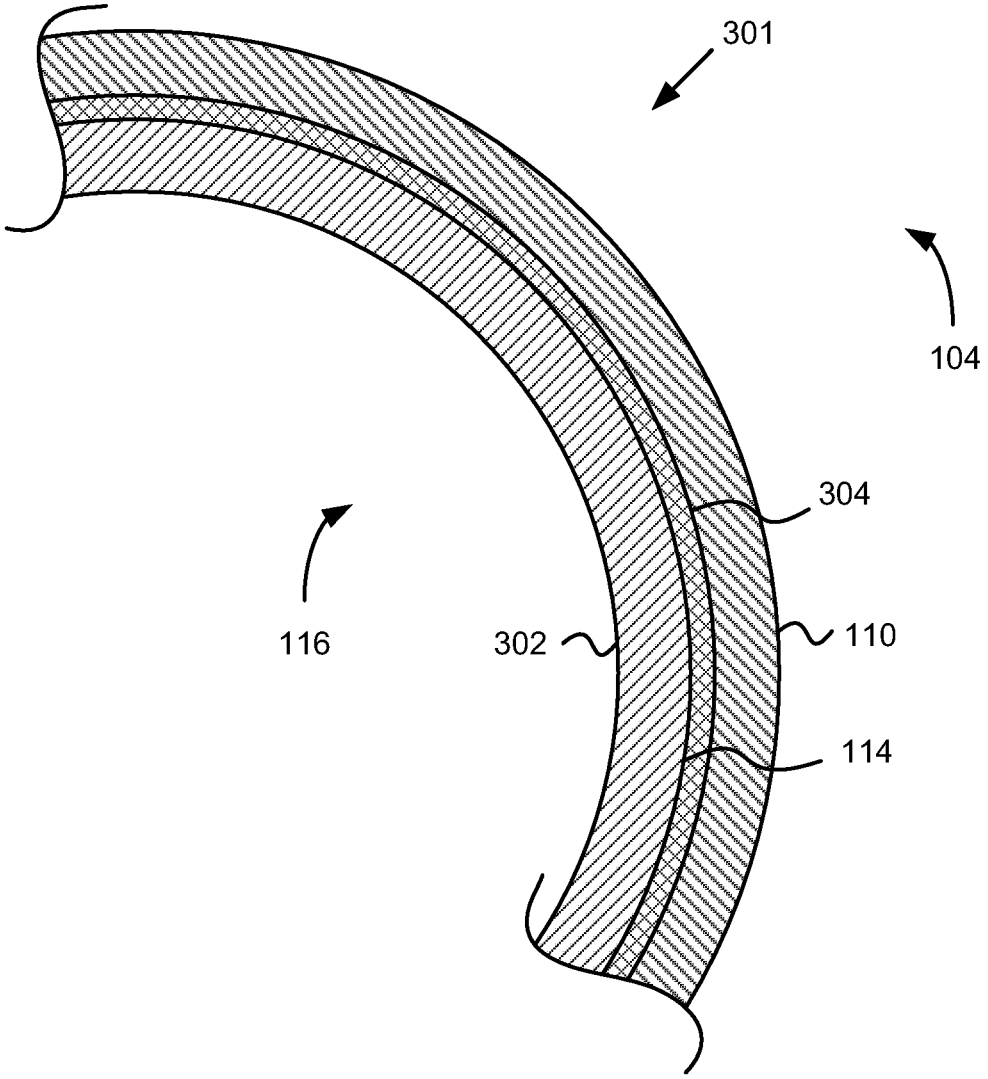
FIG. 3 is a partial cross section of an integrated electrode and heat transfer surface corresponding to FIG. 2, according to an embodiment.

In the embodiment 201, the heat transfer surface 114 includes the first electrode 110. FIG. 3 is a partial cross section of an apparatus 301 including an integrated electrode 110 and heat transfer surface 114 corresponding to FIG. 2, according to an embodiment.

According to an embodiment, the integrated apparatus 301 may form at least a portion of a wall of a fire tube or water tube boiler, for example. For example, the heat transfer surface 114 may include a tube or pipe wall that includes an opposing surface 302 abutting a heat sink 116. The heat sink 116 may include a flowing liquid, vapor, and/or steam. Alternatively, the heat transfer surface may separate a heated gas stream 104 from a convective or forced air heat sink 116, such as in an air-to-air heat exchanger. According to another embodiment, the heat sink 116 may represent a solid heat conductor, a heat pipe, or other apparatus that is configured to be heated by the heated gas 104. According to some embodiments, the heat transfer surface may include the surface of a heat sink 116 that is substantially solid of a heat conductor, and there may be substantially no opposite wall 302. In some embodiments, such as in the case of a fire tube boiler embodiment for example, the radius depicted in FIG. 3 may be flattened or reversed.

According to some embodiments, it may be desirable to provide an apparatus 301 including an integrated electrode 110 and heat transfer surface 114 wherein the electrode 110 is electrically isolated from the heat transfer surface 114. The embodiment 301 may include a thermally conductive wall extending from the heat transfer surface 114. The thermally conductive wall may extend to an opposite surface 302 or may extend to an extension of the heat transfer surface 114 (such as in a cylindrical heat sink 116) or may extend to an opposite surface that is discontinuous from the heat transfer surface 114, but which is adiabatic.

An electrical insulator 304 may be disposed over at least a portion of the thermally conductive wall extending from the heat transfer surface 114. The first electrode 110 may include an electrically conductive layer disposed over at least a portion of the electrical insulator 304.

Various electrical insulators 302 may be used. According to embodiments, the electrical insulator 302 may be selected for a relatively high dielectric constant (at least at a modulation frequency of the first electrode 110), a melting point or glass transition temperature high enough to avoid degradation, a relatively high thermal conductivity, a relatively low coefficient of thermal expansion, and/or a coefficient of thermal expansion that is relatively well-matched to that of the material in the wall extending from the heat transfer surface 114 and/or the electrode layer 110. For example, the electrical insulator 304 may include one or more of polyether-ether-ketone, polyimide, silicon dioxide, silica glass, alumina, silicon, titanium dioxide, strontium titanate, barium strontium titanate, or barium titanate. Lower dielectric materials such as polyimide, polyether-ether-ketone, silicon dioxide, silica glass, or silicon may be most appropriate for the insulation layer for embodiments using lower voltages and/or greater insulator thicknesses.

According to embodiments, the conductive layer of the electrode 110 may be selected to have relatively high conductivity and relatively high melting point. For example, the first electrode 110 may include one or more of graphite, chromium, an alloy including chromium, an alloy including molybdenum, tungsten, an alloy including tungsten, tantalum, an alloy including tantalum, or niobium-doped strontium titanate.

According to some embodiments, the at least one electrode 110 may include a portion that is deposited prior to operation, e.g. a metal, crystal, or graphite, and a portion that is deposited during operation, for example carbon particles such as conductive soot or conductive ash. A useful dynamic may occur when a portion of the conductivity of the at least one electrode 110 accrues from a deposit formed during operation. Electrodes or electrode regions that exhibit increased coupling efficiency, for example owing to system geometry, power output, stoichiometry, and/or fuel flow/heated air flow rate, may tend to attract a relatively greater particle impingement. The relatively greater particle impingement may tend to erode or displace the deposited matter. The removal of the deposited matter that forms a portion of the electrode may result in a decrease in coupling efficiency to the heated gas 104. The resultant decrease in coupling efficiency may reduce the amount of particle impingement, and hence erosion. According to an embodiment, these effects may help to provide a pseudo-equilibrium that may equalize "pull" on charged particles across the extent of an electrode or across an array of electrodes.

Referring back to FIGS. 1 and 2, the voltage source 112 may be configured to drive the at least one first electrode 110, and optionally at least one second electrode 120 with electrical waveforms. As indicated above, modulating the at least one first electrode 110 may include driving the first electrode 110 to one or more voltages selected to attract oppositely charged species 106, 108, and the attracted oppositely charged species may then impart momentum transfer to the heated gas. An optional at least one second electrode 120 may be driven with a waveform selected to at least partially sweep some of the charged species 106, 108, such as electrons 108, out of the flow of the heated gas 104. The electrical waveforms that drive the at least one first electrode 110 and the optional at least one second electrode 120 may include a dc voltage waveform, an ac voltage waveform, an ac voltage with dc bias, non-periodic fluctuating waveforms, and/or combinations thereof.

Figure 4:
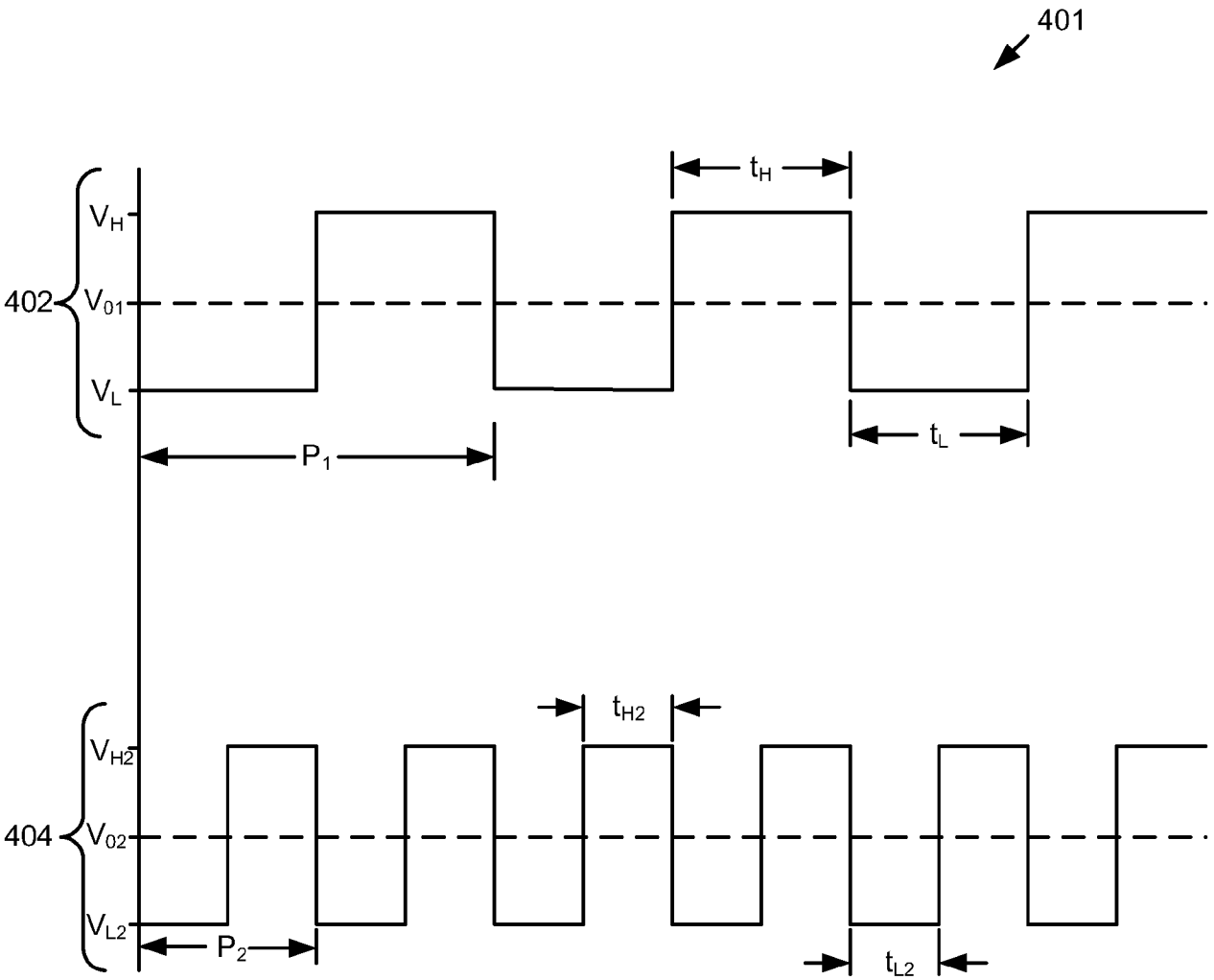
FIG. 4 is a waveform diagram showing illustrative waveforms for driving electrodes of FIGS. 1-3, according to an embodiment.

FIG. 4 is a waveform diagram 401 showing illustrative waveforms for driving electrodes 110, 120 of FIGS. 1-3, according to an embodiment. The waveform 402 depicts an illustrative approach to driving the at least one first electrode 110. For multiple electrode 110 systems, a common waveform 402 may drive all the electrodes 110. Alternatively, one or more of the multiple electrodes 110 may be driven by a waveform 402 different from other waveforms 402 used to drive the other multiple electrodes 110.

According to an embodiment, the waveform 402 may temporally modulate between a high voltage $V_H$ and a low voltage $V_L$ in a pattern characterized by a period $P_1$. The high voltage $V_H$ and low voltage $V_L$ may be selected as equal magnitude variations above and below a mean voltage $V_{01}$. The mean voltage $V_{01}$ may be a ground voltage or may be a constant or variable voltage $V_{01}$ representing a dc bias from ground. The absolute value $|V_H-V_{01}|=|V_L-V_{01}|$ may be greater than, less than, or about equal to the absolute value $|V_{01}|$. In other words, the high voltage $V_H$ may be above, about equal to, or below ground, depending on the embodiment. Similarly, the low voltage $V_L$ may be above, about equal to, or below ground, depending on the embodiment.

The period $P_1$ includes a duration $t_L$ corresponding to the low voltage $V_L$ and another duration $t_H$ corresponding to the high voltage $V_H$. According to some embodiments $t_L+t_H=P_1$. According to other embodiments (not shown), the period may include a portion of time during which the voltage may be held at the mean voltage $V_{01}$, to yield $t_L+t_H<P_1$. For embodiments where $V_L$ is below ground, a positive species duty cycle D+ may be defined as $D+=t_L/(t_L+t_H)$. Similarly, for embodiments where $V_H$ is above ground, a negative species duty cycle D− may be defined as $D-=t_H/(t_L+t_H)$. For a single electrode 110, the positive species duty cycle D+ and the negative species duty cycle D− are not linearly independent. However, linearly independent positive species and negative species duty cycles, D+, D− may be provided by spatially separated electrodes 110.

For the embodiments 110, 210 illustrated in FIGS. 1 and 2, and assuming constant $V_L<0$ and constant $V_H>0$, effects of a waveform 402 will be described. During period $P_1$ portions $t_L$, the electrode 110 provides an electrostatic attraction to positive species 106 in the heated gas stream 104 and imparts a drift velocity on the positive species 106 toward the electrode 110. The drift velocity may be at an angle to the mass flow velocity 105 when the electrode 110 is positioned lateral to the mass flow velocity 105. During portions $t_L$, the electrode 110 may tend to repel negative species 108 entrained within the heated gas stream 104.

During period $P_1$ portions $t_H$, the electrode 110 provides an electrostatic attraction to negative species 108 in the heated gas stream 104 and imparts a drift velocity on the negative species 108 toward the electrode 110. The drift velocity may be at an angle to the mass flow velocity 105 when the electrode 110 is positioned lateral to the mass flow velocity 105. During portions $t_H$, the electrode 110 may tend to repel positive species 106 entrained within the heated gas stream 104.

For a substantially constant $V_L$, a larger positive species duty cycle D+ provides a greater amount of positive species 106 attraction and a lower positive species duty cycle D+ provides a lesser amount of positive species 106 attraction. The positive species duty cycle D+ provided by the voltage source 112 may be varied according to the amount of drift momentum desired to be impressed upon the heated gas stream 104. For example, at a higher flow rate 105, a higher positive species duty cycle D+ may be useful for maximizing positive species 106 flux, and hence maximizing heat extraction from the heated gas 104.

Similarly, for a substantially constant $V_H$, a larger negative species duty cycle D− provides a greater amount of negative species 108 attraction, and a lower negative species duty cycle D− provides a lesser amount of negative species 108 attraction. The negative species duty cycle D− provided by the voltage source 112 may be varied according to the amount of drift momentum desired to be impressed upon the heated gas stream 104. For example, at a higher flow rate 105, a higher negative species duty cycle D− may be useful for maximizing negative species 108 flux, hence maximizing heat extraction from the heated gas 104.

The period $P_1$ may be selected according to a range of considerations. For example, the concentration of positive and/or negative species 106, 108 in the heated gas stream may at least partly determine an effective impedance and/or conductivity related to an effective relative dielectric constant, which may, in turn, affect a frequency-dependence of the electrostatic coupling efficiency to the heated gas 104. According to another example, the mass/charge ratio of the positive and/or negative species may affect their frequency dependent momentum response to the waveform 402. Other things being equal, larger period $P_1$ may provide higher electrostatic coupling efficiency to more massive species 106, 108. A shorter period $P_1$, on the other hand, may be advantageous for avoiding arcing, especially when voltages $V_H$ and/or $V_L$ have large absolute magnitudes relative to grounded surfaces abutting the heated gas 104.

Depending on the mix of positive species 106 and negative species 108 in the vicinity of the at least one electrode 110 and the heat transfer surface 114, one or the other of the positive species duty cycle D+ or the negative species duty cycle D− may be of greater importance for increasing the heat flux to the heat transfer surface 114. As described above, at least one second electrode 120, which may be positioned nearer the burner assembly 103 and combustion locus 102 than the at least one first electrode 110, may be used to purge a portion of charged species 106 or 108 from the heated gas 104. Purging a portion of the charged species 106 or 108 from the heated gas 104 may tend to reduce charge recombination and corresponding reduction in charged species 106 or 108 present while the heated gas traverses a region in the vicinity of the at least one first electrode 110 and heat transfer surface 114. Additionally, purging a portion of charged species 106 or 108 may result in a charge imbalance in the vicinity of the at least one electrode 110 and the heat transfer surface 114. The charge imbalance may be used to advantage by preferentially attracting the higher concentration species.

For example, electrons 108 may be swept out of the heated gas 104 by at least one second electrode 120. Returning again to FIG. 4, waveform 404 illustrates a waveform that may be provided by the voltage source 112 to the at least one second electrode 120 to sweep one or more charged species out of the heated air column 104. For example, the at least one second electrode may sweep electrons out of the gas stream 104, resulting in a positive charge imbalance in the vicinity of the at least one first electrode 110 and the heat transfer surface 114. The electrons may combine with a positively charged conductor including the at least one second electrode 120 and thereafter be conducted away to the voltage source 112.

According to an embodiment, the waveform 404 may modulate between a high voltage $V_{H2}$ and a low voltage $V_{L2}$ in a pattern characterized by a period $P_2$. The high voltage $V_{H2}$ and low voltage $V_{L2}$ may be selected as equal magnitude variations above and below a mean voltage $V_{02}$. The mean voltage $V_{02}$ may be a ground voltage or may be a constant or variable voltage $V_{02}$ representing a dc bias from ground. The absolute value $|V_{H2}-V_{02}|=|V_{L2}-V_{02}|$ may be greater than, less than, or about equal to the absolute value $|V_{02}|$. In other words, the high voltage $V_{H2}$ may be above, about equal to, or below ground, depending on the embodiment. Similarly, the low voltage $V_{L2}$ may be above, about equal to, or below ground, depending on the embodiment.

The period $P_2$ includes a duration $t_{L2}$ corresponding to the low voltage $V_{L2}$ and another duration $t_{H2}$ corresponding to the high voltage $V_{H2}$. According to some embodiments $t_{L2}+t_{H2}=P_2$. According to other embodiments (not shown), the period may include a portion of time during which the voltage may be held at the mean voltage $V_{02}$, to yield $t_{L2}+t_{H2}<P_2$. For embodiments where $V_{L2}$ is below ground, a positive species duty cycle $D+_2$ may be defined as $D+_2=t_{L2}/(t_{L2}+t_{H2})$. Similarly, for embodiments where $V_{H2}$ is above ground, a negative species duty cycle $D-_2$ may be defined as $D-_2=t_{H2}/(t_{L2}+t_{H2})$. For a single electrode 120, the positive species duty cycle $D+_2$ and the negative species duty cycle $D-_2$ are not linearly independent. However, linearly independent positive species and negative species duty cycles, $D+_2$, $D-_2$ may be provided by spatially separated electrodes 120.

For the embodiments 110, 210 illustrated in FIGS. 1 and 2, and assuming constant $V_{L2}<0$ and constant $V_{H2}>0$, effects of a waveform 404 will be described. During period $P_2$ portions $t_{L2}$, the electrode 120 provides an electrostatic attraction to positive species 106 in the heated gas stream 104 and imparts a drift velocity on the positive species 106 toward the electrode 120. The drift velocity may be at an angle to the mass flow velocity 105 when the electrode 120 is positioned lateral to the mass flow velocity 105. During portions $t_{L2}$, the electrode 120 may tend to repel negative species 108 entrained within the heated gas stream 104.

During period $P_2$ portions $t_{H2}$, the electrode 120 provides an electrostatic attraction to negative species 108 in the heated gas stream 104 and imparts a drift velocity on the negative species 108 toward the electrode 120. The drift velocity may be at an angle to the mass flow velocity 105 when the electrode 120 is positioned lateral to the mass flow velocity 105. During portions $t_{H2}$, the electrode 120 may tend to repel positive species 106 entrained within the heated gas stream 104.

For a substantially constant $V_{L2}$, a larger positive species duty cycle $D+_2$ provides a greater amount of positive species 106 attraction and a lower positive species duty cycle $D+_2$ provides a lesser amount of positive species 106 attraction. The positive species duty cycle $D+_2$ provided by the voltage source 112 may be varied according to the amount of positive species 106 desired to be removed from the heated gas stream 104. For example, at a higher flow rate 105, a higher positive species duty cycle $D+_2$ may be useful for maximizing positive species 106 flux, and hence maximizing the withdrawal of positive species from the heated gas 104.

Similarly, for a substantially constant $V_{H2}$, a larger negative species duty cycle $D-_2$ provides a greater amount of negative species 108 attraction, and a lower negative species duty cycle $D-_2$ provides a lesser amount of negative species 108 attraction. The negative species duty cycle $D-_2$ provided by the voltage source 112 may be varied according to the amount of negative species to be removed from the heated gas stream 104. For example, at a higher flow rate 105, a higher negative species duty cycle $D-_2$ may be useful for maximizing negative species 108 flux, hence maximizing negative species extraction from the heated gas 104.

The period $P_2$ may be selected according to a range of considerations. For example, the concentration of positive and/or negative species 106, 108 in the heated gas stream may at least partly determine an effective impedance and/or conductivity related to an effective relative dielectric constant, which may, in turn, affect a frequency-dependence of the electrostatic coupling efficiency to the heated gas 104. According to another example, the mass/charge ratio of the positive and/or negative species may affect their frequency dependent momentum response to the waveform 404. Other things being equal, larger period $P_2$ may provide higher electrostatic coupling efficiency to more massive species 106, 108. A shorter period $P_2$, on the other hand, may be advantageous for avoiding arcing or avoiding the undesirable removal of move massive charged species 106, 108, especially when voltages $V_{H2}$ and/or $V_{L2}$ have large absolute magnitudes relative to grounded surfaces abutting the heated gas 104.

According to an illustrative embodiment, at least one second electrode 120 may be configured to sweep a portion of electrons from the heated gas 104, but avoid sweeping other negative species from the heated gas 104. For example, the period $P_2$ of the second electrode modulation may be selected to impart sufficient momentum on electrons to withdraw a portion of the free electrons. More massive negative particles respond (accelerate) more slowly to the force imparted by the electrical field because of the inverse mass relationship between force and acceleration. Hence, a relatively short period $P_2$ may result in an acceleration of electrons to the surface of the second electrode, but leave more massive negative species in the heated gas 104.

At least one first electrode 110 may be configured to primarily drive remaining and relatively massive positive species including unburned fuel and ash toward a heat transfer surface 114. For example, for a system including a 7.6 cm diameter tube enclosing the heated volume and a heated gas 104 velocity of about 90 cm/second, the at least one first electrode 110 may be modulated between about 0 volts and −10,000 volts at a frequency of about 300 Hz at a 97% duty cycle. This results in the at least one first electrode 110 being periodically modulated to −10 kV for 3.22 milliseconds and then to 0V for 0.1 milliseconds, for a total period of 3.32 milliseconds (301.2 Hz).

According to an embodiment, the at least one first electrode 110 may produce an electric field strength of about 1 kV/cm. Because of the large number of collisions between species in the heated gas 104, acceleration may be ignored and moderate mass positively charged species 106 (e.g. $CO^+$, $C_3H_8^+$, etc.) in the stream (along with entrained gas and particles) may be approximated to be imparted with a nominal drift velocity toward the first electrode 110 (and hence the heat transfer surface 114) of about 1000 cm/second. In comparison to an embodiment having a typical gas flow rate of about 100 cm/second, one may appreciate that driving the at least one first electrode 110 may significantly affect the transfer of heat through the heat transfer surface 114.

At least one second electrode 120 may be configured to primarily drive electrons out of the heated gas 104. For example for a system using a burner nozzle as the second electrode 120 centered in a 7.6 cm diameter tube and a heated gas velocity of about 90 cm/second, the second electrode 120 may be modulated between about 0 volts and +10,000 volts at a frequency of about 300 Hz at a 97% duty cycle. This results in the at least one second electrode 120 being periodically modulated to +10 kV for 3.22 milliseconds and then to 0V for 0.1 milliseconds, for a total period of 3.32 milliseconds (301.2 Hz). Another second electrode 120 modulation schema may provide 50% duty cycle modulation between 0V and +10,300V at a frequency of 694.4 kHz.

According to an embodiment, the at least one second electrode 120 may produce an electric field strength of about 1 kV/cm. Because of the large number of collisions between species in the heated gas 104, acceleration may be ignored and low mass negatively charged species 106 (e.g. $e^-$) in the stream may be approximated to be imparted with a nominal drift velocity toward the second electrode 120 of about $10^5$ cm/second, which is more than sufficient to overcome an illustrative gas flow rate of 100 cm/sec. However, because of the low mass of electrons, relatively little momentum is transferred to other species in the heated gas 104, thus avoiding entrainment, and significant flow of heat to the second electrode 120 may be avoided.

Figure 5:
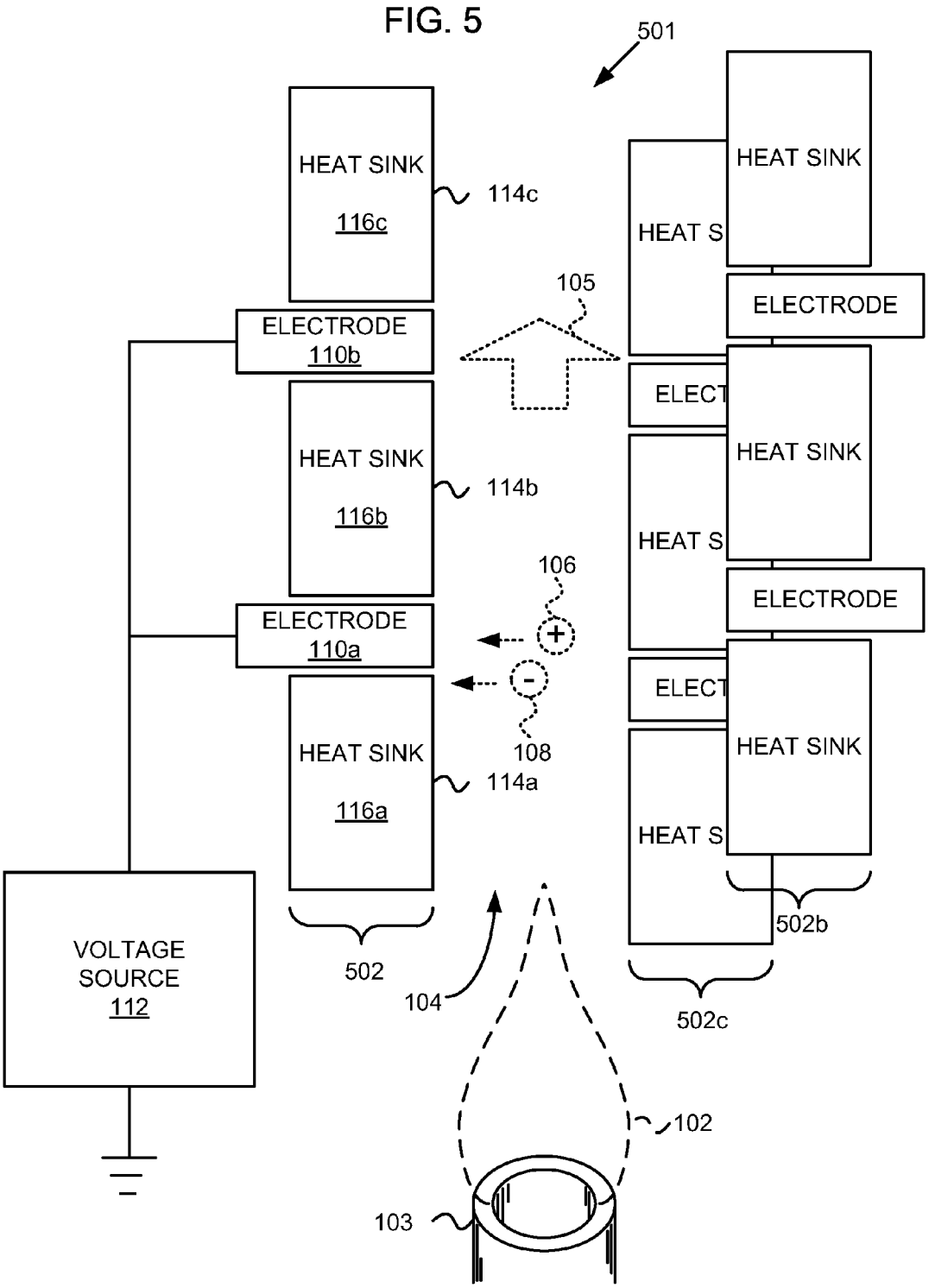
FIG. 5 is a diagram of a system configured with a plurality of electrodes and heat transfer surfaces, according to an embodiment.

FIG. 5 is a diagram of a system 501 configured with a plurality of first electrodes 110*a*, 110*b* and heat transfer surfaces 114*a*, 114*b*, 114*c*, according to an embodiment. The plurality of first electrodes 110*a-b* and heat transfer surfaces 114*a-c* may be arranged to respectively drive and receive heat transfer from a heated gas stream 104 generated by at least one combustion locus or flame 102 supported by at least one burner assembly 103. The at least one combustion reaction supported by the at least one burner assembly 103 may evolve positively charged species 106 and negatively charged species 108 into the heated gas stream 104.

The plurality of first electrodes may be driven with a common waveform from a voltage source 112 or with separate waveforms. The plurality of first electrodes 110*a*, 110*b* may be configured to impart drift velocities to the positively charged species 106 and/or the negatively charged species 108 at a plurality of angles to a nominal mass flow velocity 105. A heat transfer surface may include a plurality of heat transfer surfaces 114*a-c*. The plurality of heat transfer surfaces 114*a-c* may correspond to a common heat sink or to a corresponding plurality of heat sinks 116*a-c*.

For example, a common heat sink 116*a* may correspond to a water tube in a boiler. The water tube may, for example, include an electrically insulating layer (not shown) formed over substantially the entirety of the water tube. A plurality of electrodes 110*a-b* may be formed as patterned conductors over the insulating layer (not shown) on the water tube 116*a*. The plurality of heat transfer surfaces 114*a-c* may correspond to regions between the patterned electrodes 110*a-b*.

According to an alternative embodiment, the plurality of heat transfer surfaces 114*a-c* may correspond to a plurality of heat sinks 116*a-c*. For example, at least a portion of the plurality of first electrodes 110*a*, 110*b* may be interdigitated with at least a portion of the plurality of heat transfer surfaces 114*a-c*. The heat sinks 116*a-c* and heat transfer surfaces 114*a-c* may optionally be electrically conductive. The plurality of first electrodes 110*a-b* may be separated from the heat transfer surfaces 114*a-c* by air gaps. The air gaps may insulate the plurality of first electrodes 110*a-b* from the plurality of heat transfer surfaces 114*a-c* and/or the plurality of heat sinks 116*a-c*.

A plurality of heat transfer surfaces 114*a-c* and corresponding plurality of heat sinks 116*a-c* may form a heat sink array 502. A system 501 may include a plurality of heat sink arrays 502, 502*b*, 502*c*. The heat sink arrays 502, 502*b*, 502*c* may include electrodes driven by a common voltage source 112, or by a corresponding plurality of voltage sources (not shown).

Figure 6:
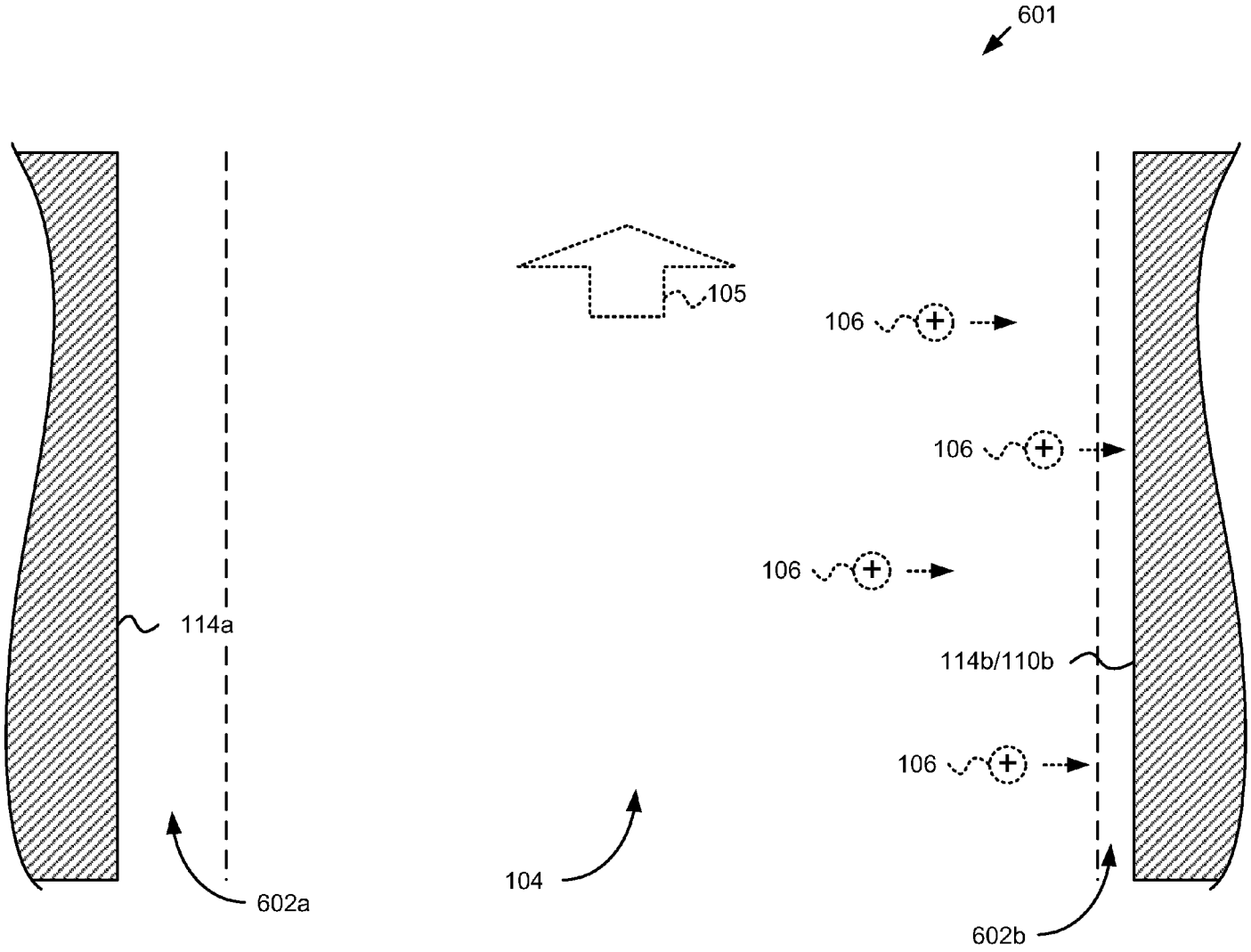
FIG. 6 is a close-up sectional view of a heat transfer surface illustrating an effect of impinging charged species on a boundary layer, according to an embodiment.

FIG. 6 is a close-up sectional view 601 of heat transfer surfaces 114*a*, 114*b* illustrating an effect of impinging charged species 106, 108 (and any entrained non-charged species) on boundary layers 602*a*, 602*b*, according to an embodiment. A heated gas stream 104 includes a bulk flow velocity 105. Heat transfer surfaces 114*a*, 114*b* may be disposed adjacent to the heated gas stream 104.

A first heat transfer surface 114*a*, may not include a corresponding electrode, or may represent a moment during which a corresponding electrode is not modulated to attract a charged species. A boundary layer 602*a* lies over the heat transfer surface 114*a*. The boundary layer 602*a* may represent a thickness of relatively quiescent air across which thermal diffusion and/or radiation may dominate as heat transfer mechanisms over convective heat transfer. Even in cases where the heated air stream 104 as a whole is moving with sufficient velocity 105 to provide convective heat transfer, for example as turbulent flow, the boundary layer 602*a* may be present. In cases where the heated air average velocity 105 is high enough to reach a Reynolds number characteristic of turbulent flow, the boundary layer 602*a* may be characterized as a turbulent boundary layer.

Convective heat transfer and/or heat transfer between regions outside the boundary layer 602*a* is characterized by a higher heat transfer coefficient than heat transfer across the boundary layer 602*a*. The thickness of the boundary layer 602*a* may be proportional to its resistance to heat transfer from the heated air stream 104 to the heat transfer surface 114*a*.

A second heat transfer surface 114*b* includes a corresponding electrode 110*b* that is modulated or energized to attract charged species 106 from the heated air stream 104. The corresponding electrode 110*b* may, for example, include a conduction path within a conductive wall defined at least partially by the heat transfer surface 114*b*. This may be particularly appropriate when the wall is electrically isolated and lies adjacent a substantially non-conductive heat sink, as in an air-to-air heat exchanger for example. Alternatively, the corresponding electrode 110*b* may overlie the heat transfer surface 114*b*, for example according to an embodiment corresponding to that of FIG. 3. Alternatively, the corresponding electrode 110*b* may be disposed near the heat transfer surface 114*b*. As will be appreciated, while an electrode 110*b* disposed near the heat transfer surface 114*b* may not drive the charged species 106 to accelerate toward the heat transfer surface, it may impart sufficient momentum to the charged species 106 (and any non-charged or oppositely-charged species entrained therewith) to cause them to impinge upon the heat transfer surface 114*b* as shown diagrammatically.

Charged species 106 that impinge upon the heat transfer surface 114*b* may do so by penetrating a boundary layer 602*b*. The penetration of the charged species 106 may cause the boundary layer 602*b* to be thinner than the boundary layer 602*a*. The penetration of the charged species 106 may also effectively raise the Reynolds number sufficiently to substantially convert a laminar boundary layer 602*a* to a turbulent boundary layer 602*b*. The mixing or disruption of the boundary layer 602*b* by the impinging charged species, any entrained non-charged species, and any entrained oppositely-charged species may result in raising a heat transfer coefficient for transfer of heat from the heated gas stream 104 through the heat transfer surface 114*b*.

Additionally, a combination of charged species 106 with opposite charge carriers in the electrode 110*b* may release a heat of association corresponding to a lower energy state of a neutral species. Additionally, the kinetic energy of the charged species 106 (and other entrained species) impinging on the heat transfer surface 114*b* may be converted to additional heat energy.

While the flame 102 and burner assembly 103 are depicted in FIGS. 1, 2, and 5, as resembling a gas burner and flame, various burner embodiments are contemplated. For example, the burner assembly may include one or more of a fluidized bed, a grate, moving grate, a pulverized coal nozzle, a gas burner, a gas nozzle, an oil burner, arrays of burner assemblies, or other embodiments. Flames 102 may include laminar flames, other diffusion flames, premixed flames, turbulent flames, agitated flames, stoichiometric flames, non-stoichiometric flames, or combinations thereof.

Driving Heat Away from a Surface

While description above has focused on driving heat energy toward a surface, other embodiments can drive heat energy away from a surface. Generally, this can be accomplished by inverting either the polarity of the highest concentration charged species in the gas stream, by moving the location of the electrode(s) with respect to the heat transfer (or temperature-sensitive) surface(s), by inverting the voltage waveform applied to the electrode(s), or by applying a (opposite sign) bias voltage to the waveform. In most combustion systems, the highest mass and highest stability charged species are positively charged. Therefore, for most practical solutions involving combustion systems, the best options may involve either moving the electrode(s), substantially inverting the voltage waveform applied to the electrode(s), or by applying or inverting a bias voltage to the voltage waveform.

Figure 7:
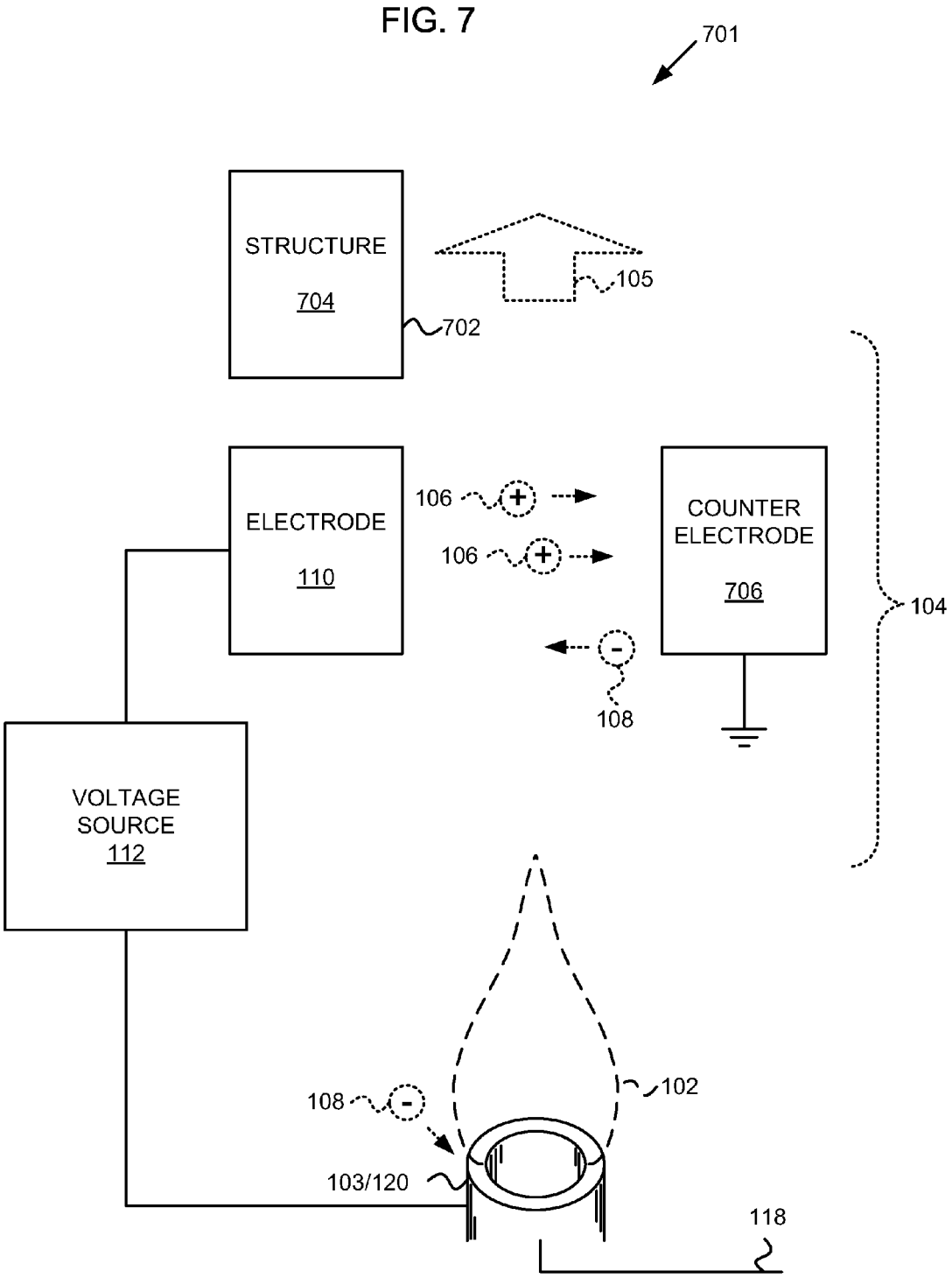
FIG. 7 is a diagram of a system configured to protect a heat-sensitive surface from heat transfer using an electric field, according to an embodiment.

FIG. 7 is a diagram of a system 701 configured to protect a temperature-sensitive surface 702 and/or an underlying temperature-sensitive structure 704 from heat transfer, according to an embodiment. The operation of the system 701 may correspond to the operation of the system 101 shown in FIG. 1, except that the electric field or the charged species population is inverted.

The system 701 may typically include a flame 102 supported by a burner assembly 103. A combustion reaction in the flame 102 generates a heated gas 104, that exhibits a mass a flow illustrated by the arrow 105, carrying electrically charged species 106, 108. Typically, the electrically charged species include positively charged species 106 and negatively charged species 108.

Providing a heated gas carrying charged species 106, 108 may include burning at least one fuel from a fuel source 118, the combustion reaction providing at least a portion of the charged species and combustion gasses. According to some embodiments, the combustion reaction may provide substantially all the charged species 106, 108.

The charged species 106, 108 may include unburned fuel; intermediate radicals such as hydride, hydroperoxide, and hydroxyl radicals; particulates and other ash; pyrolysis products; charged gas molecules; and free electrons, for example. At various stages of combustion, the mix of charged species 106, 108 may vary. As will be discussed below, some embodiments may remove a portion of the charged species 106 or 108 in a first portion of the heated gas 104, leaving a charge imbalance in another portion of the heated gas 104.

For example, one embodiment may remove a portion of negative species 108 including substantially only electrons, leaving a positive charge imbalance in the gas stream 104. Positive species 106 may then be electrostatically attracted away from the vicinity of a structure 704, resulting in reduced heat transfer across a temperature-sensitive surface 702 of the structure 704 and to the temperature-sensitive structure 704 itself. Alternatively, a portion of positive species 106 may be removed from the heated gas stream 104, leaving a negative charge imbalance in the gas stream. While the negative species 108 is shown with a drift velocity toward the structure 704 and the temperature-sensitive surface 702, the waveform applied to the voltage source may, in fact, cause a net neutral path along the mass flow 105 or may also drive the negatively charges species away from the structure 704 with its temperature-sensitive surface. This may be done by controlling modulation on-off cycles and the duty cycle of the waveform in a manner corresponding to the charge/mass ratio of the negative species 108. Alternatively, with a low enough mass negative species 108 and/or depopulation of the negative species 108, the negative species 108 may impart negligible momentum upon the gas stream 104, and thus may not result in substantial movement of heated gases toward the structure 104 and temperature-sensitive surface 702.

A first electrode 110 may be voltage modulated by a voltage source 112. The voltage modulation may be configured to create a voltage potential across the heated gas stream 104 to drive a portion of the charged species 106, here illustrated as positive, away from the structure 704 and temperature-sensitive surface 702. Modulating the first electrode may include driving the first electrode to one or more voltages selected to, in combination with a counter electrode 706, repel oppositely charged species, and the repelled oppositely charged species imparting momentum transfer to the heated gas. FIG. 7, and also, e.g., FIG. 1 or FIG. 2, illustrate first electrodes 110 that are not axially symmetrical with respect to the nominal mass flow velocity 105, meaning that, by electrostatics, they are configurable to exert forces tending to cause a drift velocity at an angle to the nominal mass flow velocity 105.

The momentum from the electrically driven charged species 106 may be transferred to non-charged particles, unburned fuel, ash, air, etc. carrying heat. The modulated first electrode 110 may be configured to repel the charged species and other entrained species carrying heat to preferentially flow away from a temperature-sensitive surface 702. As the heat-carrying species flow away from to the heat transfer surface 114, a reduced portion of the heat carried by the heated gas 105 is transferred through the temperature-sensitive surface 702 to the structure 704.

According to an embodiment, the first electrode 110 may be arranged near the temperature-sensitive surface 702. A nominal mass flow 105 may be characterized by a velocity (including speed and direction). The first electrode 110 may be configured to impart a drift velocity to the charged species 106 at an angle to the nominal mass flow velocity 105 and away from the temperature-sensitive surface 702.

As mentioned above, the system 701 may further modulate at least one second electrode 120 to remove a portion of the charged species 106, 108. According to an embodiment, the second electrode 120 may preferentially purge negatively-charged species 108 from the heated gas 104. According to an embodiment, the second electrode may preferentially purge a portion of electrons 108 from the heated gas 104.

According to an embodiment, the at least one second electrode 120 may include a burner assembly 103 that supports a flame 102, the flame 102 providing a locus for the combustion reaction. The second electrode 120 may be driven with a waveform from the voltage source 112. Alternatively, the second electrode may be driven from another voltage source or may be held at ground.

The counter electrode 706, which may be referred to as a third electrode (whether or not the optional second electrode is present), is shown as electrically coupled to ground. The third electrode 706 may optionally be formed as a grounded combustion system structure, and may thus not be an explicit structure. Optionally, the third electrode 706 may be driven from the voltage source 112 (via a connection that is not shown that replaces the ground connection) or another voltage source (not shown) with a waveform that is opposite in sign to the waveform applied to the electrode 110.

Optionally, the electrode 110 may be combined with the structure 704 or may be formed on the surface of the structure 704. For example, the first electrode 110 may be disposed over an electrical insulator and the electrical insulator is disposed over the temperature-sensitive surface 702 or the electrode 110 may be formed from the structure 704 and/or the temperature-sensitive surface 702. The electrical insulator may, for example, include at least one of polyether-ether-ketone, polyimide, silicon dioxide, silica glass, alumina, silicon, titanium dioxide, strontium titanate, barium strontium titanate, or barium titanate. The first electrode 110 may include at least one of graphite, chromium, an alloy including chromium, an alloy including molybdenum, tungsten, an alloy including tungsten, tantalum, an alloy including tantalum, or niobium-doped strontium titanate.

The structure 704 and temperature-sensitive surface 702, optional electrical insulator (not shown), and first electrode 110 may form at least a portion of a wall of a fire tube or water tube boiler. In another example, the temperature-sensitive surface 702 and the structure 704 may include a turbine blade or other structure subject to degradation by exposure to the hot gas stream 104. The temperature protection approaches shown herein may then be used to extend turbine (or other structure) life, improve reliability, reduce weight, and/or increase thrust by allowing hotter combustion gases 104 without degrading the temperature-sensitive structure(s) 704 and/or temperature-sensitive surface(s) 702. The temperature-sensitive surface 702 (and optionally structure 704) may include one or more of titanium, a titanium alloy, aluminum, an aluminum alloy, steel, stainless steel, a composite material, a fiberglass and epoxy material, a Kevlar and epoxy material, or a carbon fiber and epoxy material.

Figure 8:
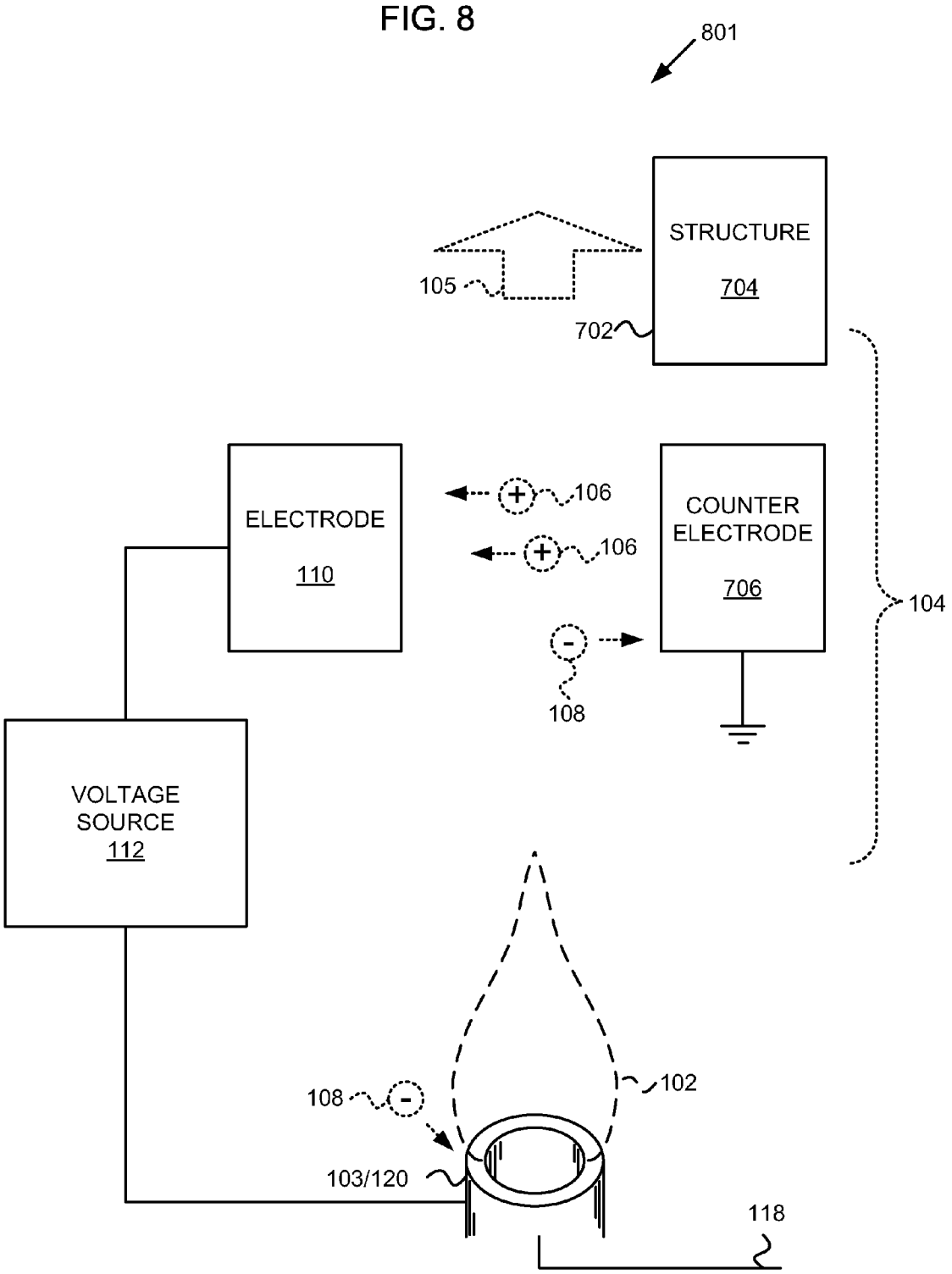
FIG. 8 is a diagram of a system configured to protect a heat-sensitive surface from heat transfer using an electric field, according to another embodiment.

Optionally, the electrode 110 may be positioned away from the structure 704 and temperature-sensitive surface 702 to directly exert an attractive force on the majority species 106. FIG. 8 is a diagram of a system configured to protect a temperature-sensitive surface 702 and/or an underlying temperature-sensitive structure 704 from heat transfer, according to an embodiment where the electrode 110 is positioned distal from the structure 704 and surface 702. The operation of the system 701 may correspond to the operation of the system 101 shown in FIG. 1, except that the position of the electrode 110 is moved away from the surface 702.

The system 801 may typically include a flame 102 supported by a burner assembly 103. A combustion reaction in the flame 102 generates a heated gas 104, that exhibits a mass a flow illustrated by the arrow 105, carrying electrically charged species 106, 108. Typically, the electrically charged species include positively charged species 106 and negatively charged species 108. Operation of the combustion portion of the system 801 and the optional second electrode 120 may be substantially identical to the operation of the system 701, as described above.

Positive species 106 and remaining negative species 108 may then be electrostatically attracted away from the vicinity of the structure 704, resulting in reduced heat transfer across a temperature-sensitive surface 702 of the structure 704 and to the temperature-sensitive structure 704 itself. Alternatively, a portion of positive species 106 may be removed from the heated gas stream 104, leaving a negative charge imbalance in the gas stream.

A first electrode 110 may be voltage modulated by a voltage source 112. The voltage modulation may be configured to create a voltage potential across the heated gas stream 104 to drive a portion of the charged species 106, here illustrated as positive, away from the structure 704 and temperature-sensitive surface 702. Modulating the first electrode may include driving the first electrode to one or more voltages selected to, in combination with a counter electrode 706, attract oppositely charged species, with the attracted oppositely charged species imparting momentum transfer to the heated gas 104. As described above, while the negative species 108 is shown with a drift velocity toward the structure 704 and the temperature-sensitive surface 702, the waveform applied to the voltage source may, in fact, cause a net neutral path along the mass flow 105 or may also drive the negatively charges species away from the structure 704 with its temperature-sensitive surface 702.

The momentum from the electrically driven charged species 106 may be transferred to non-charged particles, unburned fuel, ash, air, etc. carrying heat. The modulated first electrode 110 may be configured to attract the charged species and other entrained species carrying heat to preferentially flow away from a temperature-sensitive surface 702. As the heat-carrying species flow away from to the heat-sensitive surface 702, a reduced portion of the heat carried by the heated gas 105 is transferred through the temperature-sensitive surface 702 to the structure 704.

A counter electrode 706, which may be referred to as a third electrode (whether or not the optional second electrode is present), is shown as electrically coupled to ground. The third electrode 706 may optionally be formed as a grounded combustion system structure, and may thus not be an explicit structure. Optionally, the third electrode 706 may be driven from the voltage source 112 (via a connection that is not shown that replaces the ground connection) or another voltage source (not shown) with a waveform that is opposite in sign to the waveform applied to the electrode 110.

Optionally, the electrode 706 may be combined with the structure 704 or may be formed on the surface of the structure 704. For example, the third electrode 706 may be disposed over an electrical insulator and the electrical insulator is disposed over the temperature-sensitive surface 702 or the third electrode 706 may be formed from the structure 704 and/or the temperature-sensitive surface 702. The electrical insulator may, for example, include at least one of polyether-ether-ketone, polyimide, silicon dioxide, silica glass, alumina, silicon, titanium dioxide, strontium titanate, barium strontium titanate, or barium titanate. The third electrode 706 may include at least one of graphite, chromium, an alloy including chromium, an alloy including molybdenum, tungsten, an alloy including tungsten, tantalum, an alloy including tantalum, or niobium-doped strontium titanate.

The structure 704 and temperature-sensitive surface 702, optional electrical insulator (not shown), and third electrode 706 may form at least a portion of a wall of a fire tube or water tube boiler. In another example, the temperature-sensitive surface 702 and the structure 704 may include a turbine blade or other structure subject to degradation by exposure to the hot gas stream 104. The temperature protection approaches shown herein may then be used to extend turbine (or other structure) life, improve reliability, reduce weight, and/or increase thrust by allowing hotter combustion gases 104 without degrading the temperature-sensitive structure(s) 704 and/or temperature-sensitive surface(s) 702. The temperature-sensitive surface 702 (and optionally structure 704) may include one or more of titanium, a titanium alloy, aluminum, an aluminum alloy, steel, stainless steel, a composite material, a fiberglass and epoxy material, a Kevlar and epoxy material, or a carbon fiber and epoxy material.

Optionally, the approaches related to heat attraction (shown in FIG. 1 and elsewhere) may be combined with the approaches related to heat protection (shown in FIGS. 7 and 8). For example, the voltage source 112 may be configured to preferentially apply heat to a heat sink 116 during a portion of a cycle or for a period, and then preferentially remove heat from the heat sink structure 704 during another portion of the cycle or after the period is over. This may be used, for example, to temporarily apply higher thrust against a turbine blade, such as during periods of full military power, and then allow the turbine blades to cool in order to avoid structural failure.

While the flame 102 in FIGS. 7 and 8 is illustrated in a shape typical of a diffusion flame, other combustion reaction distributions may be provided, depending upon a given embodiment.

Various configurations of embodiments depicted in FIGS. 7 and 8 are contemplated. For example, the first electrode 110 and/or the third electrode 706 may either or each include a plurality of electrodes configured to impart drift velocities to electrically charged species at a plurality of angles to the nominal mass flow velocity. The first electrode 110 and/or the third electrode 706 may include a plurality of first electrodes 110 and/or third electrodes 706, and the temperature-sensitive surface 702 (and structure(s) 704) may include a plurality of temperature-sensitive surfaces 702 (704). At least a portion of the plurality of first electrodes 110 may then be interdigitated with at least a portion of the plurality of temperature-sensitive surfaces 702.

As indicated above, the voltage waveform provided by the voltage source 112 may be driven as indicated elsewhere herein, typically inverted or at an opposite bias for the arrangement 701 of FIG. 7, or directly as previously shown for the arrangement 801 of FIG. 8. The waveform may include a dc negative voltage, an ac voltage including a negative portion, or an ac voltage on a dc negative bias voltage for the arrangement of FIG. 8. Similarly, the waveform may include a dc positive voltage, an ac voltage including a positive portion, or an ac voltage on a dc positive bias voltage for the arrangement of FIG. 7.

The descriptions and figures presented herein are necessarily simplified to foster ease of understanding. Other embodiments and approaches may be within the scope of inventions described herein. Inventions described herein shall be limited only according to the appended claims, which shall be accorded their broadest valid meaning.

What is claimed is:

1. An apparatus for enhancing heat transfer from a combustion reaction comprising: a combustion source; a heat transfer surface positioned in a hot gas stream including electrically charged species from a combustion reaction supported by the combustion source; and a first electrode configured to be temporally modulated to create a field that attracts positively charged species from the combustion reaction to a vicinity of the heat transfer surfaces wherein the hot gas stream has a nominal mass flow velocity; and wherein the first electrode is not axially symmetrical with respect to the nominal mass flow velocity, whereby the first electrode is configured to impart a drift velocity to the positively charged species at an angle to the nominal mass flow velocity.

2. The apparatus of claim 1, wherein the first electrode is arranged near the heat transfer surface.

3. The apparatus of claim 1, wherein the first electrode includes a plurality of electrodes configured to impart drift velocities to positively charged species at a plurality of angles to the nominal mass flow velocity.

4. The apparatus of claim 1, wherein the first electrode includes a plurality of first electrodes and the heat transfer surface includes a plurality of heat transfer surfaces.

5. The apparatus of claim 4, wherein at least a portion of the plurality of first electrodes are interdigitated with at least a portion of the plurality of heat transfer surfaces.

6. The apparatus of claim 1, wherein the first electrode is disposed over the heat transfer surface.

7. The apparatus of claim 6, wherein the first electrode is disposed over an electrical insulator and the electrical insulator is disposed over the heat transfer surface.

8. The apparatus of claim 7, wherein the electrical insulator includes at least one of polyether-ether-ketone, polyimide, silicon dioxide, silica glass, alumina, silicon, titanium dioxide, strontium titanate, barium strontium titanate, or barium titanate.

9. The apparatus of claim 7, wherein the first electrode includes at least one of graphite, chromium, an alloy including chromium, an alloy including molybdenum, tungsten, an alloy including tungsten, tantalum, an alloy including tantalum, or niobium-doped strontium titanate.

10. The apparatus of claim 7, wherein the heat transfer surface, insulator, and electrical insulator form at least a portion of a wall of a fire tube or water tube boiler.

11. The apparatus of claim 1, further comprising a voltage source configured to drive the electrode with a periodic waveform.

12. The apparatus of claim 11, wherein the waveform includes a dc negative voltage, an ac voltage including a negative portion, or an ac voltage on a dc negative bias voltage.

13. The apparatus of claim 1, further comprising a second electrode configured to sweep a portion of electrons from the hot gas stream.

14. The apparatus of claim 13, wherein the second electrode includes a burner assembly configured to support a flame, and the supported flame provides a locus for the combustion reaction.

15. An apparatus for reducing heat transfer from a combustion reaction comprising: a combustion source; a temperature-sensitive surface positioned in a hot gas stream including electrically charged species from a combustion reaction supported by the combustion source; and a first electrode configured to be temporally modulated creating a field to drive the electrically charged species from the combustion reaction to a location away from the temperature-sensitive surface, wherein the hot gas stream has a nominal mass flow velocity; and wherein the first electrode is not axially symmetrical with respect to the nominal mass flow velocity, whereby the first electrode is configured to impart a drift velocity to the positively charged species at an angle to the nominal mass flow velocity.

16. The apparatus of claim 15, wherein the first electrode is arranged near the heat transfer surface.

17. The apparatus of claim 15, wherein the first electrode is arranged away from the heat transfer surface.

18. The apparatus of claim 15, wherein the electrically charged species are positively charged species.

19. The apparatus of claim 15 wherein the first electrode includes a plurality of electrodes configured to impart drift velocities to electrically charged species at a plurality of angles to the nominal mass flow velocity.

20. The apparatus of claim 15, wherein the first electrode includes a plurality of first electrodes and the temperature-sensitive surface includes a plurality of temperature-sensitive surfaces.

21. The apparatus of claim 20, wherein at least a portion of the plurality of first electrodes are interdigitated with at least a portion of the plurality of temperature-sensitive surfaces.

22. The apparatus of claim 15, wherein the first electrode is disposed over the temperature-sensitive surface.

23. The apparatus of claim 15, wherein the first electrode is disposed over an electrical insulator and the electrical insulator is disposed over the temperature-sensitive surface or comprises the temperature-sensitive surface.

24. The apparatus of claim 23, wherein the electrical insulator includes at least one of polyether-ether-ketone, polyimide, silicon dioxide, silica glass, alumina, silicon, titanium dioxide, strontium titanate, barium strontium titanate, or barium titanate.

25. The apparatus of claim 23, wherein the first electrode includes at least one of graphite, chromium, an alloy including chromium, an alloy including molybdenum, tungsten, an alloy including tungsten, tantalum, an alloy including tantalum, or niobium-doped strontium titanate.

26. The apparatus of claim 23, wherein the temperature-sensitive surface, electrical insulator, and first electrode form at least a portion of a wall of a fire tube or water tube boiler.

27. The apparatus of claim 15, wherein the temperature-sensitive surface includes a turbine blade.

28. The apparatus of claim 15, wherein the temperature-sensitive surface includes one or more of titanium, a titanium alloy, aluminum, an aluminum alloy, steel, stainless steel, a composite material, a fiberglass and epoxy material, a Kevlar and epoxy material, or a carbon fiber and epoxy material.

29. The apparatus of claim 15, further comprising a voltage source configured to drive the electrode with a periodic waveform.

30. The apparatus of claim 29, wherein first electrode is positioned away from the temperature-sensitive surface; and wherein the waveform includes a dc negative voltage, an ac voltage including a negative portion, or an ac voltage on a dc negative bias voltage.

31. The apparatus of claim 29, wherein first electrode is positioned near or coincident with the temperature-sensitive surface; and wherein the waveform includes a dc positive voltage, an ac voltage including a positive portion, or an ac voltage on a dc positive bias voltage.

32. The apparatus of claim 15, further comprising a second electrode configured to sweep a portion of electrons from the hot gas stream.

33. The apparatus of claim 32, wherein the second electrode includes a burner assembly configured to support a flame, and the supported flame provides a locus for the combustion reaction.

34. The apparatus of claim 15, further comprising a third electrode configured as a counter-electrode to the first electrode.

35. The apparatus of claim 34, wherein the third electrode comprises the temperature-sensitive surface or is formed over the temperature-sensitive surface.

* * * * *